US005564284A

United States Patent [19]

Pugin

[11] Patent Number: 5,564,284

[45] Date of Patent: Oct. 15, 1996

[54] RECYCLING WATER COOLER

[76] Inventor: Darrell Pugin, 600 Lundy Rd., #10, Auburndale, Fla. 33823

[21] Appl. No.: 283,243

[22] Filed: Jul. 29, 1994

[51] Int. Cl.[6] ..... F25B 49/00

[52] U.S. Cl. ..... 62/126; 62/434; 62/DIG. 22; 62/185

[58] Field of Search ..... 62/185, 183, 430, 62/434, DIG. 22, 260, 177, 125, 126, 129

[56] References Cited

U.S. PATENT DOCUMENTS

| | | | |
|---|---|---|---|
| 3,807,190 | 4/1974 | Grant | 62/183 |
| 4,720,984 | 1/1988 | Ames | 64/434 |

*Primary Examiner*—John M. Sollecito
*Attorney, Agent, or Firm*—Frijouf, Rust & Pyle, P.A.

[57] ABSTRACT

An improved recycling water cooler for a water cooled refrigeration system comprising first conduits interconnecting the water cooled refrigeration system and the recycling water cooler and the ambient water source for enabling the flow of water therebetween. Second conduits interconnect the water cooled refrigeration system and the recycling water cooler and the drain for enabling the flow of water therebetween. A first and second valve is interposed in the first and second conduits for enabling heated water discharged from the water cooled refrigeration system to enter the recycling water cooler to be cooled thereby and to be returned to the water cooled refrigeration system when the first and second valves are disposed in a first position. The first and second valves interconnect the water cooled refrigeration system to the ambient water source and to a drain for operating the water cooled refrigeration system in a conventional manner when the first and second valves are disposed in a second position.

10 Claims, 5 Drawing Sheets

PRIOR ART

RECYCLING WATER COOLER

BACKGROUND OF THE INVENTION

1. Field of the Invention

This invention relates to refrigeration and more particularly to an improved recycling water cooler for a water cooled refrigeration system.

2. Background of the Invention

Refrigeration systems for domestic and commercial use may be found in a wide variety of configurations. Although these refrigeration systems appear in a variety of configurations, the refrigeration systems operate on a common fundamental principal.

In general, heat is removed from a refrigerated volume such as a closure or container and the removed heat is rejected or dissipated into a heat sink that absorbs the heat removed from the refrigerator volume. This transfer of heat is common to all refrigeration systems regardless of the type of refrigeration system.

In many refrigeration systems, the heat sink may be an ambient flow of air which is commonly referred to as an air cooled refrigeration system or the heat sink may be an ambient flow of water which is commonly referred to as a water cooled refrigeration system. In an air cooled refrigeration system wherein an ambient flow of air is used as the heat sink, heat is removed from the refrigerator volume by an evaporator and is dissipated into ambient air flowing through a condenser. In a water cooled refrigeration system wherein an ambient flow of water is used as the heat sink, heat is removed from the refrigerator volume and is dissipated into an ambient flowing water source through a heat exchanger. Although both the air cooled refrigeration systems and the water cooled refrigeration systems function satisfactorily for various purposes, the water cooled refrigeration systems are more efficient due to the greater capacity of water to absorb heat relative to the capacity of ambient air to absorb heat. Furthermore, the water cooled refrigeration systems are frequently less complicated and smaller in size than a corresponding air cooled refrigeration system.

With the higher efficiency of water cooled refrigeration system, the water cooled refrigeration systems have found widespread use in the art especially in commercial installations for various refrigeration systems such as commercial refrigerators and commercial ice makers.

The shortage of potable water in some areas have resulted in a substantial increase in the cost of potable water. Accordingly, the use of flowing potable water for absorbing heat in a water cooled refrigeration system has become a substantial cost to the operation of water cooled refrigeration systems. Although these water cooled refrigeration systems may at one time have been more economical for operation than air cooled refrigeration systems, with the recent rise in the cost of potable water, in many areas, the operation of a water cooled refrigeration system is now more expensive than a similar air cooled refrigeration system.

Therefore it is an object of this invention to provide an improved recycling water cooler for a water cooled refrigeration system for the conservation of water.

Another object of this invention is to provide an improved recycling water cooler for a water cooled refrigeration system wherein the water cooled refrigeration system may be operated in conjunction with the recycling water cooler or may be operated independently thereof as originally designed as a water cooled refrigeration system.

Another object of this invention is to provide an improved recycling water cooler for a water cooled refrigeration system which is low cost and easy to install for converting a water cooled refrigeration system.

Another object of this invention is to provide an improved recycling water cooler for a water cooled refrigeration system having an improved control for automatically transferring the water cooled refrigeration system from operating in conjunction with the recycling water cooler back to an original water cooled refrigeration system upon the unlikely event of failure of the recycling water cooler.

Another object of this invention is to provide an improved recycling water cooler for a water cooled refrigeration system which may be readily and inexpensively installed to provide a significant conservation of water.

Another object of this invention is to provide an improved recycling water cooler for a water cooled refrigeration system which may be operated at a considerable savings to the water cooled refrigeration system user.

Another object of this invention is to provide an improved recycling water cooler for a water cooled refrigeration system which may be adapted to a wide variety of water cooled refrigeration systems.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved recycling water cooler for a water cooled refrigeration system, comprising first conduit means interconnecting the water cooled refrigeration system and the recycling water cooler and an ambient water source for enabling the flow of water therebetween. Second conduit means interconnects the water cooled refrigeration system and the recycling water cooler and a drain for enabling the flow of water therebetween. A first and second valve means is interposed in the first and second conduit means for enabling heated water discharged from the water cooled refrigeration system to enter the recycling water cooler to be cooled thereby and to be returned to the water cooled refrigeration system when the first and second valves are disposed in a first position. The first and second valve means interconnect the water cooled refrigeration system to the ambient water source and to the drain for operating the water cooled refrigeration system in a conventional manner when the first and second valve means are disposed in a second position.

In a more specific embodiment of the invention, the water cooled refrigeration system has a first input and a first output. The water cooled refrigeration system transfers heat from a refrigerated volume to ambient water entering the first input from an ambient water source for discharging heated water from the first output into a drain. The recycling water cooler has a second input and a second output. The recycling water cooler transfers heat from the warm water entering the second input and discharges cool water from the second output. The improved converter comprises first conduit means interconnecting the first input of the water cooled refrigeration system, the second output of the recycling water cooler and the ambient water source for enabling the flow of water therebetween. Second conduit means interconnects the first output of the water cooled refrigeration system, the second input of the recycling water cooler and the drain for enabling the flow of water therebetween. A first valve means having a first and a second position is interposed in the first conduit means. A second valve means having a first and a second position is interposed in the second conduit means. A control means is connected to the first valve means and the second valve means for positioning the first and second valve means in the first position for interconnecting the first output to the second input and for interconnecting the second output to the first input for enabling heated water discharged from first output of the water cooled refrigeration system to enter the second input of the recycling water cooler to be cooled thereby and to be returned from the second output into the first input of the water cooled refrigeration system. The control means positions the first and second valve means in the second position for interconnecting the first input to the ambient water source for discharging heated water from the first output into a drain for operating the water cooled refrigeration system in a conventional manner.

In one embodiment of the invention, the improved converter includes sensor means for generating a signal indicative of a malfunction of the recycling water cooler. The control means positions the first and second valve means in the second position for interconnecting the first input to the ambient water source for discharging heated water from the first output into a drain upon a signal indicative of a malfunction. An alarm means generates an alarm signal upon a signal indicative of a malfunction.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
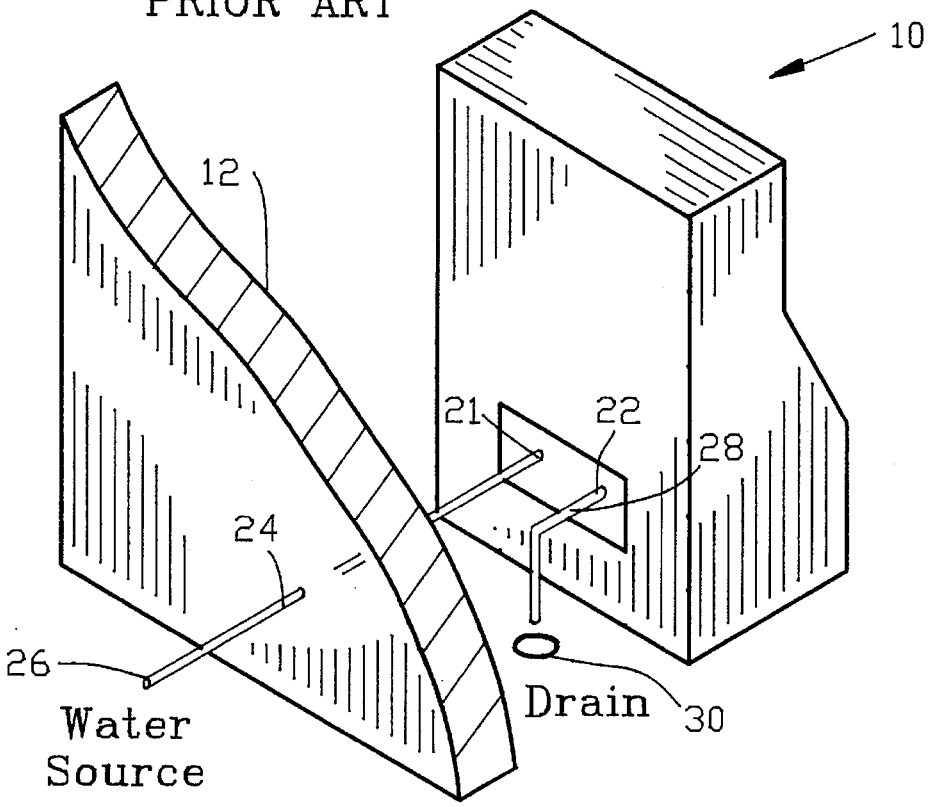
FIG. 1 PRIOR ART
FIG. 1 is an isometric view of a prior art water cooled refrigeration system located within a building structure.
Figure 2:
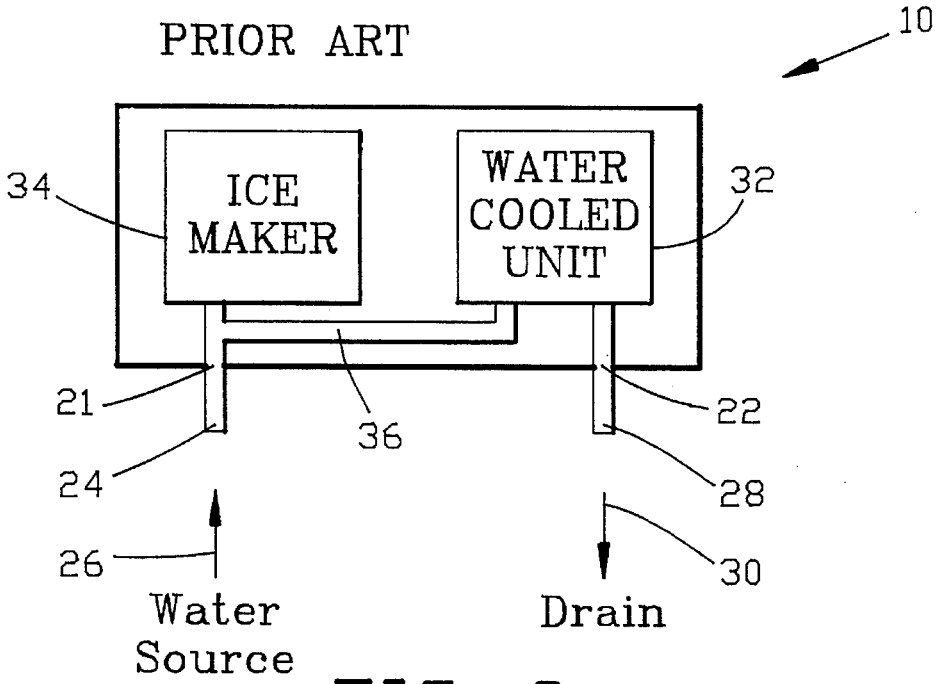
FIG. 2 is a block diagram of the water cooled refrigeration system of FIG. 1.

FIG. 1 is an isometric view of a water cooled refrigeration system 10 located within a building structure defined by a wall 12. FIG. 2 is a block diagram of the water cooled refrigeration system 10 of FIG. 1. The water cooled refrigeration system 10 has a first input 21 and a first output 22. The first input 21 is connected by a conduit 24 to an ambient water source 26 such as a conventional water line of potable water. The first output 22 is connected by a conduit 28 to a drain 30.

FIG. 2 is a block diagram of the water cooled refrigeration system 10 of FIG. 1. In this embodiment, the water cooled refrigeration system 10 is shown as water cooled refrigeration unit 32 connected to a refrigerated volume shown as an ice maker 34. Although the refrigerated volume is shown as an ice maker 34, it should be understood by those skilled in the art that virtually any refrigerated volume may be used with the present invention.

The ambient water source 26 shown as a conventional water line flows into the first input 21 to furnish potable water to the ice maker 34 and to the water cooled refrigeration unit 32 through a conduit 36. The water cooled refrigeration unit 32 transfers heat from the ice maker 34 to freeze the ambient water entering the first input 21 to create ice thereby. In addition, the ambient water entering the first input 21 is directed by the conduit 36 to absorb heat removed from the ice maker 34 by the water cooled refrigeration unit 32. The entering ambient water absorbs the heat removed from the ice maker 34 and heat is removed as heated water from the first output 22 into the drain 30. Although the use of potable water flowing through conduit 36 and discharged from the first output 22 into the drain 30 provide an efficient cooling for the water cooled refrigeration system 10, the use of flowing potable water for absorbing heat in a water cooled refrigeration unit 32 has become a substantial cost to the operation of water cooled refrigeration systems 10. This increase in cost of the operation of the water cooled refrigeration systems 10 is due to the shortage of potable water in some areas and the requirements to conserve potable water.

Figure 3:
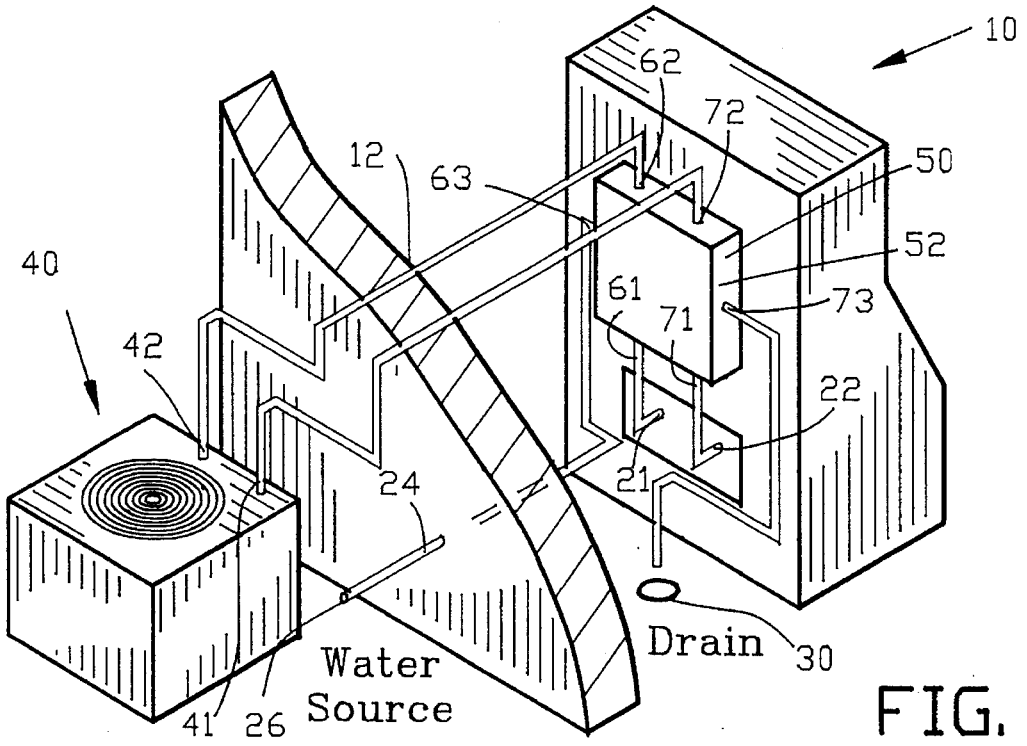
FIG. 3 is an isometric view of a water cooled refrigeration system of FIG. 1 located within a building structure interconnected with the improved recycling water cooler of the present invention located outside of the building structure.

FIG. 3 is an isometric view of the water cooled refrigeration system 10 of FIG. 1 located within a building structure defined by the wall 12. The water cooled refrigeration system 10 is shown interconnected with an improved recycling water cooler 40 located outside of the building structure defined by the wall 12.

Figure 4:
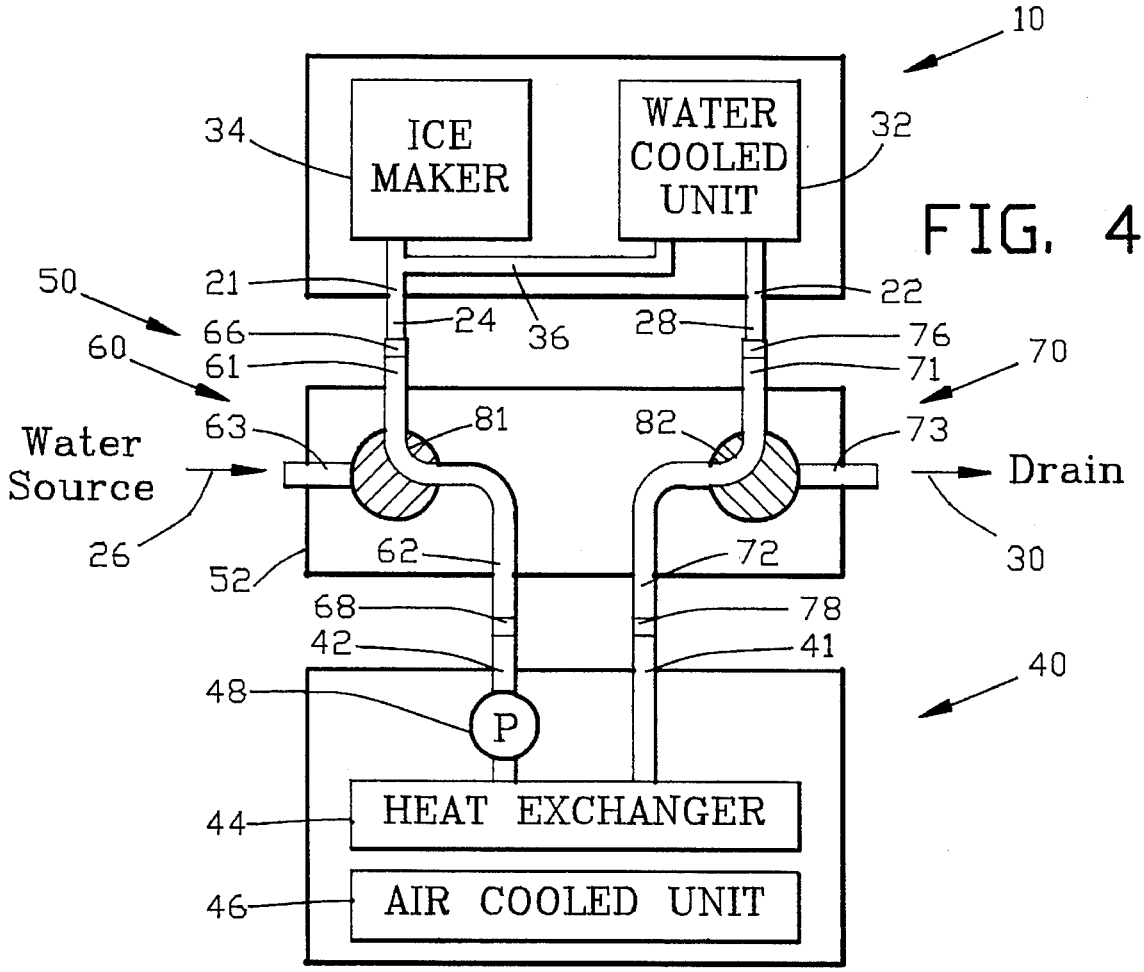
FIG. 4 is a block diagram of the water cooled refrigeration system interconnected with the improved recycling water cooler of FIG. 3.

FIG. 4 is a block diagram of the water cooled refrigeration system 10 interconnected with the recycling water cooler 40 of FIG. 2. The water cooled refrigeration system 10 in FIG. 3 operates identically as the operation set forth in FIGS. 1 and 2. The recycling water cooler 40 has a second input 41 and a second output 42. The recycling water cooler 40 includes a heat exchanger 44 and an air cooled refrigeration unit 46. The heat exchanger 44 of the recycling water cooler 40 removes heat from warm water entering the second input 41 and transfers the heat to the air cooled refrigeration unit 46. The air cooled refrigeration unit 46 transfers the heat to ambient air. After the heat is removed from the warm water entering the second input 41, cool water is discharged from the second output 42. Preferably the air cooled refrigeration unit 46 includes a compressor and a condenser in combination with the heat exchanger 44 as will be explained in greater detail hereinafter. A pump 48 is interposed at the second output 42 for pumping the cool water therefrom.

The water cooled refrigeration system 10 is interconnected to the recycling water cooler 40 by a converter 50 of the present invention. The converter 50 is disposed in a case 52 which is affixable to the water cooled refrigeration system 10 as shown in FIG. 3 or may be affixed to any convenient location. The converter 50 includes first conduit means 60, second conduit means 70 and first and second valve means 81 and 82. The first conduit means 60 comprises conduits 61–63 interconnecting the first input 21 of the water cooled refrigeration system 10, the second output 42 of the recycling water cooler 40 and the ambient water source 26. A fluid coupling 66 interconnects conduit 61 with conduit 24 whereas a fluid coupling 68 interconnects conduit 62 with the second output 42 of the recycling water cooler 40 for enabling rapid installation of the present invention on existing water cooled refrigeration system 10. The first valve means 81 is interposed in the first conduits 61–63 for enabling the flow of water therebetween. The first valve means 81 is moveable between a first position and a second position as will be described in greater detail hereinafter.

The second conduit means 70 comprises conduits 71–73 interconnecting the first output 22 of the water cooled refrigeration system 10, the second input 41 of the recycling water cooler 40 and the drain 30. A fluid coupling 76 interconnects conduit 71 with conduit 28 whereas a fluid coupling 78 interconnects conduit 72 with the second input 41 of the recycling water cooler 40 for enabling rapid installation of the present invention on existing water cooled refrigeration system 10. The second valve means 82 is interposed in the second conduits 71–73 for enabling the flow of water therebetween. The second valve means 82 is moveable between a first position and a second position as will be described in greater detail hereinafter.

Figure 5:
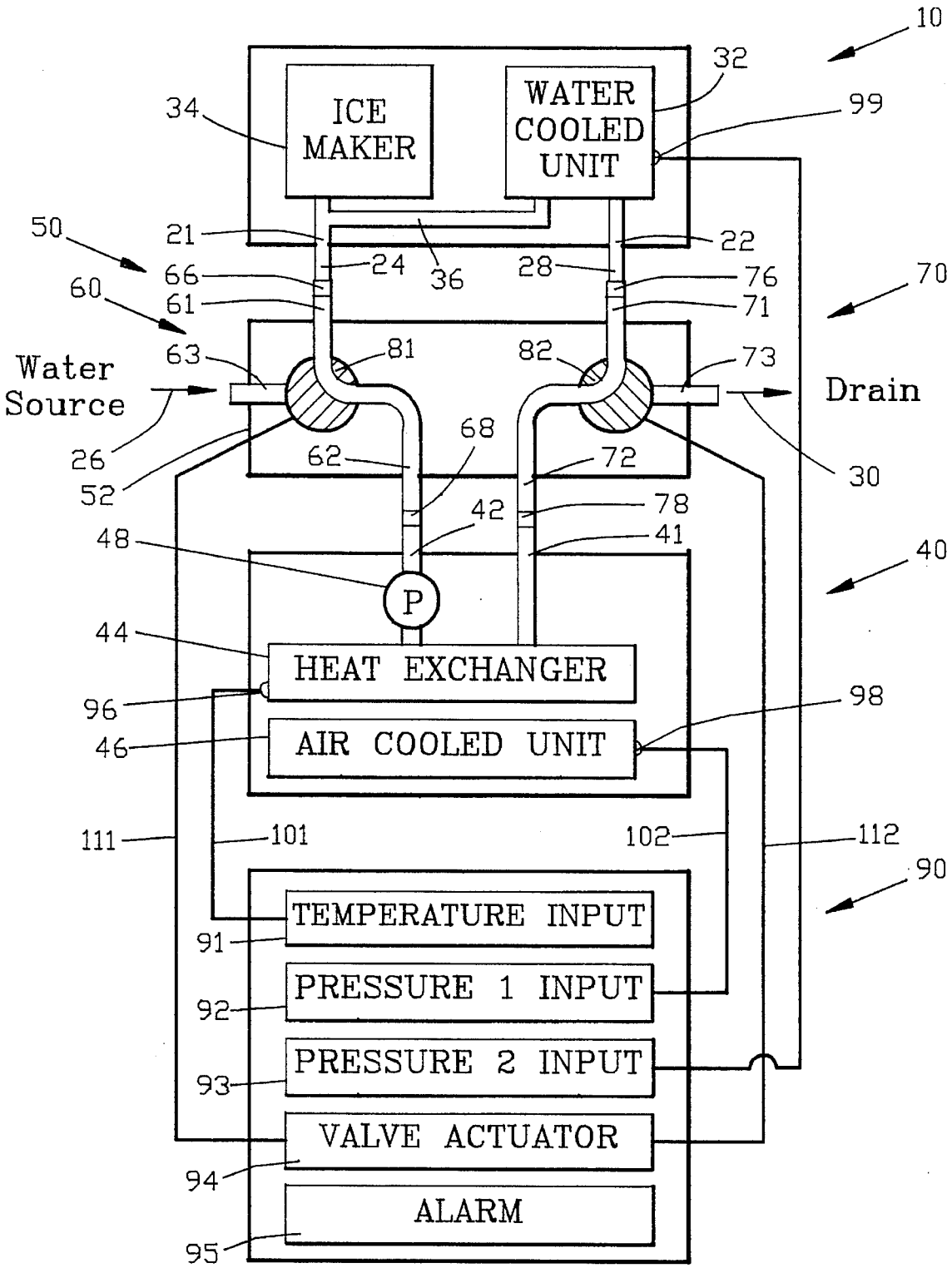
FIG. 5 is a block diagram of the water cooled refrigeration system interconnected with the improved recycling water cooler with a first and a second valve being located in a first position for enabling heated water discharged from the water cooled refrigeration system to be cooled by the improved recycling water cooler.

FIG. 5 is a block diagram of the water cooled refrigeration system 10 interconnected with the recycling water cooler 40 through the converter 50 with a control means 90 for controlling the position of the first and second valves 81 and 82. FIG. 5 illustrates the first and second valves 81 and 82 in a first position.

Figure 6:
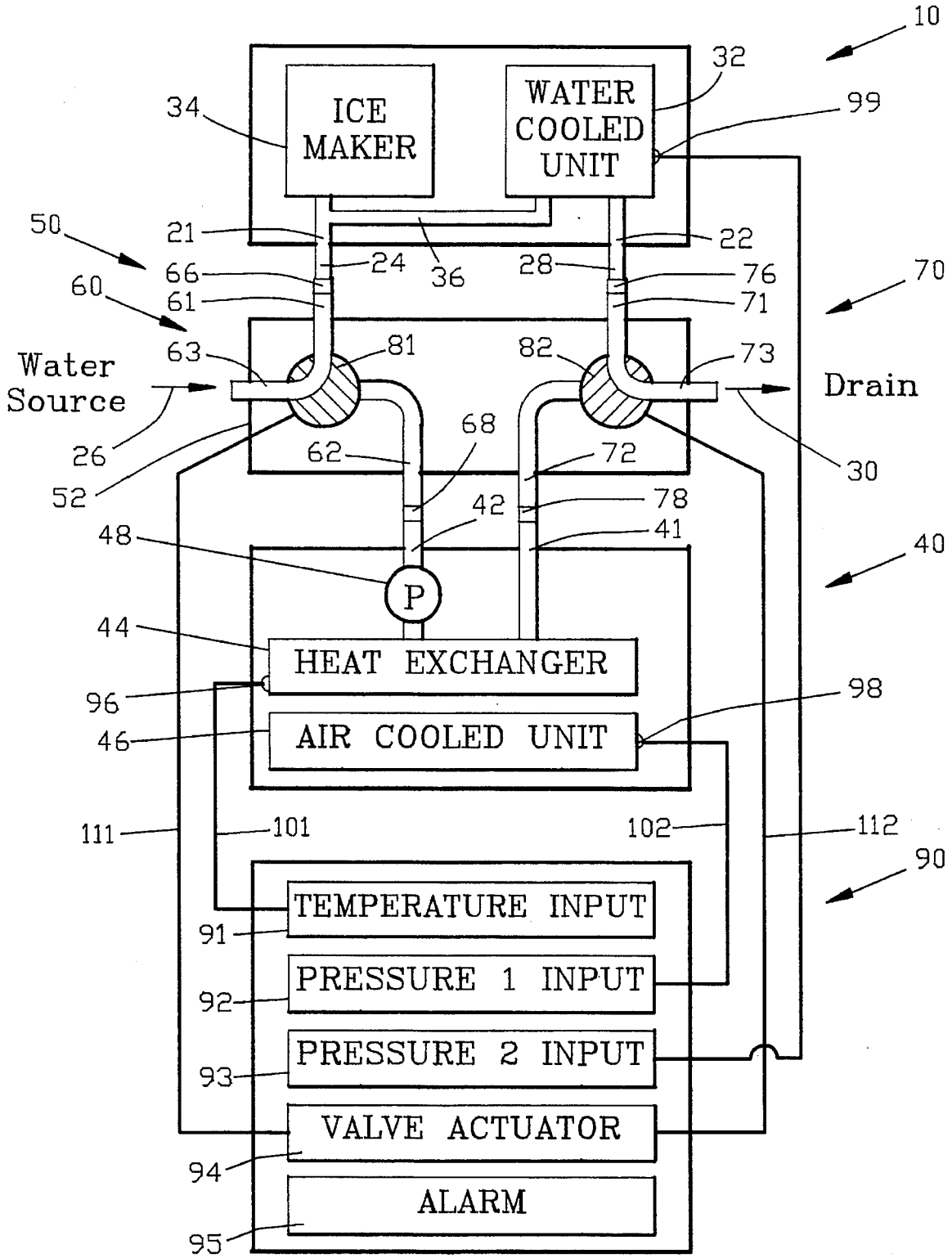
FIG. 6 is a block diagram of the water cooled refrigeration system interconnected with the improved recycling water cooler with the first and second valves being located in a first position for enabling the water cooled refrigeration system to operate in a conventional manner.

FIG. 6 is a block diagram similar to FIG. 5 with the first and second valves 81 and 82 being shown in a second position. The control means 90 controls the first and second valves 81 and 82 in unison. Accordingly, when the first valve 81 is in the first position, the second valve 82 is likewise in the first position as shown in FIG. 5. Conversely, when the first valve 81 is in the second position, the second valve 82 is likewise in the second position as shown in FIG. 6.

When the first and second valves 81 and 82 are disposed in the first position as shown in FIG. 5, the first input 21 of the water cooled refrigeration system 10 is connected to the second output 42 of the recycling water cooler 40 and the first output 42 of the water cooled refrigeration system 10 is connected to the second input 41 of the recycling water cooler 40. In addition, when the first and second valves 81 and 82 are disposed in the first position, heated water discharged from the first output 22 of the water cooled refrigeration system 10 enters the second input 41 of the recycling water cooler 40 to be cooled thereby. The cooled water discharged from the second output 42 of the recycling water cooler 40 is returned to the first input 21 of the water cooled refrigeration system 10. Accordingly, the flowing water for cooling of the water cooled refrigeration system 10 is continuously recirculated to conserve potable water thereby.

The control means 90 includes a temperature input 91, a first pressure input 92, a second pressure input 93, a valve actuator 94 and an alarm 95 for detecting a malfunction in the recycling water cooler 40. The control means 90 automatically transfers the water cooled refrigeration system 10 to operate in a conventional manner in the event of a malfunction of the recycling water cooler 40.

In the event of a malfunction of the recycling water cooler 40, the heat exchanger 44 will not receive the proper cooling and the water cooled refrigeration system 10 will likewise malfunction. A malfunction of the recycling water cooler 40 will result in an increase in the temperature within the heat exchanger 44 and accordingly an increase in the temperature of the water discharged from the second output 42. A malfunction of the recycling water cooler 40 will result also in an increase in the pressure on the high pressure side of the compressor internal the recycling water cooler 40.

The converter 70 is provided with a temperature sensor 96 for generating a signal indicative of the temperature within the heat exchanger 44. In addition, the converter 70 is provided with a first pressure sensor 98 for generating a signal indicative of the pressure on the high pressure side of the compressor internal the recycling water cooler 40. The temperature sensor 96 is connected by an electrical connector 101 to the temperature input 91 internal the control means 90 whereas the first pressure sensor 98 is connected by an electrical connector 102 to the pressure input 92 internal the control means 90.

In the event of a malfunction of the recycling water cooler 40, the temperature sensor 96 and/or the pressure sensor 98 will provide a signal to the temperature input 91 and/or the pressure input 92 of the control means 90. Upon the control means 90 receiving a signal at the temperature input 91 and/or the pressure input 92, the valve actuator 94 will actuate the first and second valves 81 and 82 into the second position by electrical connectors 111 and 112 as shown in FIG. 6.

When the first and second valves 81 and 82 are disposed in the second position as shown in FIG. 6, the first input 21 of the water cooled refrigeration system 10 is connected to the ambient water source 26. The ambient water source 26 flows into the first input 21 of the water cooled refrigeration system 10 to furnish water to the water cooled refrigeration unit 32. The ambient water entering the first input 21 absorbs heat removed by the water cooled refrigeration unit 32. The ambient water entering the first input 21 absorbs heat and the heat is removed as heated water discharged from the first output 22 into the drain 30. When the first and second valves 81 and 82 are disposed in the second position as shown in FIG. 6, the water cooled refrigeration system 10 operates in a conventional manner as shown in FIGS. 1 and 2.

The converter 70 is provided with a second pressure sensor 99 for generating a signal indicative of the pressure on the high pressure side of the compressor internal the water cooled refrigeration system 10. In the event of a malfunction of the compressor internal the water cooled refrigeration system 10, the pressure sensor 99 will provide a signal to the second pressure input 93 of the control means 90 to terminate operation of the water cooled refrigeration system 10 and the recycling water cooler 40.

Upon the control means 90 receiving a signal at the temperature input 91 and/or the first pressure input 92, the alarm 94 will activate to alert an operator of the malfunction of the recycling water cooler 40. However, the water cooled refrigeration system 10 will continue to operate in a conventional manner while repairs are undertaken on the recycling water cooler 40. Upon the control means 90 receiving a signal at the second pressure input 93, the alarm 94 will activate to alert an operator of the malfunction of the water cooled refrigeration system 10 and the control means 90 will terminate operation of the water cooled refrigeration system 10 and the recycling water cooler 40.

Figure 7:
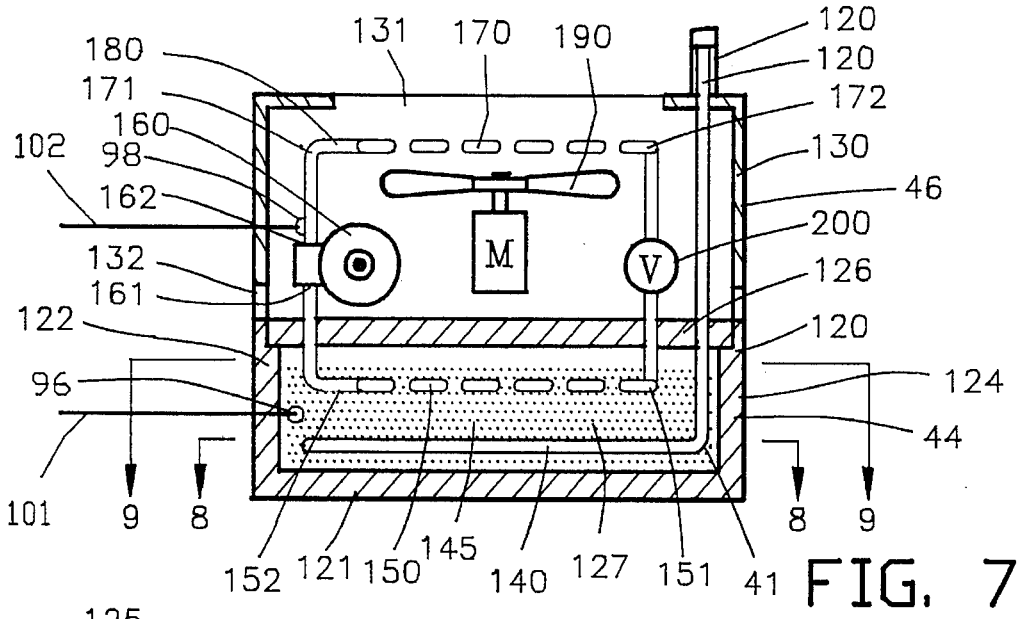
FIG. 7 is an enlarged side sectional view of the recycling water cooler of FIG. 3.
Figure 8:
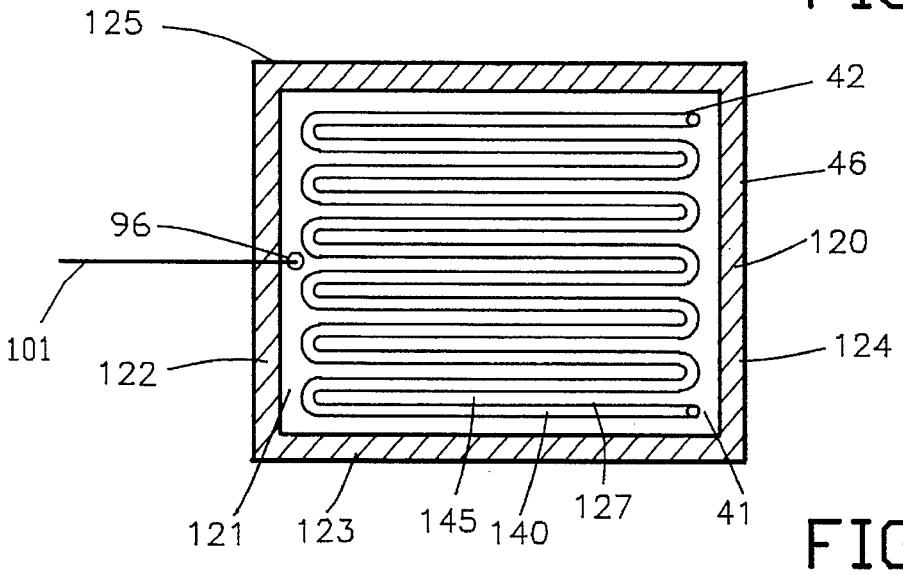
FIG. 8 is a sectional view along line 8—8 in FIG. 7.
Figure 9:
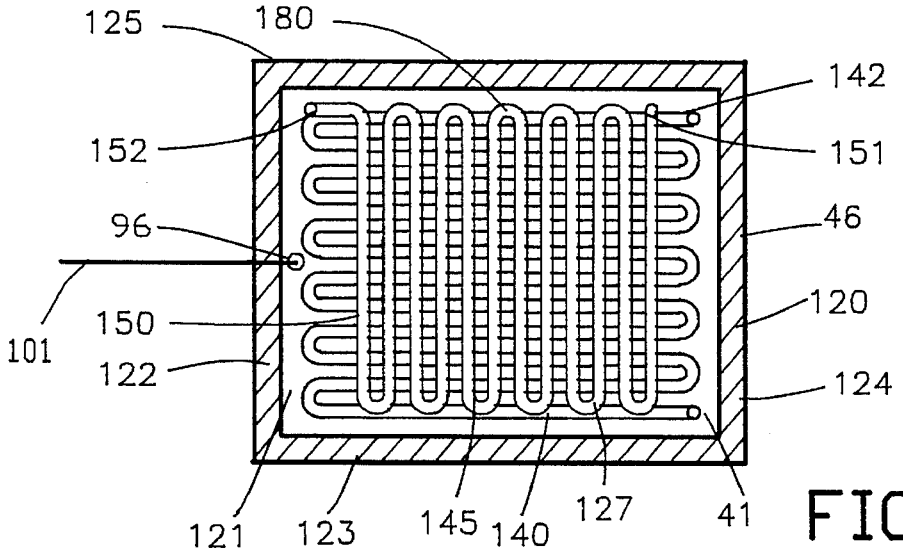
FIG. 9 is a sectional view along line 9—9 in FIG. 7.

FIG. 7–8 are enlarged views illustrating the recycling water cooler 40 of FIG. 3 including the heat exchanger 44 and the air cooled refrigeration unit 46. The recycling water cooler 40 comprises an insulated lower container 120 having a bottom wall 121 and sidewalls 122–125 with a removable cover 126 for accessing an interior 127 of the lower container 120. The air cooled refrigeration unit 46 is enclosed within an upper container 130 having an upper aperture 131 and lower apertures 132.

The heat exchanger 44 comprises a heat exchanger coil 140 disposed within the interior 127 of the lower container 120 and extends between the second input 41 and the second output 42. The heat exchanger coil 140 defines a serpentine path within the interior 127 of the lower container 120. A thermally conductive liquid 145 such as water is disposed within the interior 127 of the lower container 120 and in thermal contact with the heat exchanger coil 140. The serpentine path of the heat exchanger coil 140 increases the surface area of the heat exchanger coil 140 in contact with the thermally conductive liquid 145 to increase the transfer of heat therebetween. The temperature sensor 96 is disposed within the interior 127 of the lower container 120 and in thermal contact with the thermally conductive liquid 145 for generating the signal indicative of the temperature within the heat exchanger 44.

The air cooled refrigeration unit 46 comprises an evaporator coil 150, a compressor 160 and a condenser coil 170 for circulating a refrigerant 180. The evaporator coil 150 has a serpentine path extending between a first and a second end 151 and 152. The compressor 160 is located within the upper container 130 and includes an input 161 and an output 162. The first pressure sensor 98 is secured proximate to the output 162 of the compressor 160 for generating the signal indicative of an excess pressure at the output 162 of the compressor 160.

The condenser coil 170 has a serpentine path extending between a first and a second end 171 and 172. The condenser coil 170 is located within the upper container 130 adjacent the upper aperture 131. A fan 190 provides a forced air flow from the lower apertures 132 to pass across the condenser coil 170 to exit from the upper aperture.

The input 161 of the compressor 160 is connected to the second end 152 of the evaporator coil 150 whereas the output 162 of the compressor 160 is connected to the first end 171 of the condenser coil 170. The second end 172 of the condenser coil 170 is connected through a pressure differential valve 200 to the first end 151 of the evaporator coil 150.

The heat from the warm water entering the second input 41 of the heat exchanger 40 is transferred to the thermally conductive liquid 145 within the interior 127 of the lower container 120. After the heat is removed from the warm water entering the second input 41 of the heat exchanger 40, cool water is discharged from the second output 42. The heat absorbed by the thermally conductive liquid 145 from the heat exchanger 40 is absorbed by the evaporator coil 150 for transfer to the refrigerant 180. The refrigerant 180 is drawn into the input 161 of the compressor 160 whereat the refrigerant 180 is compressed by the compressor 160.

The compressed refrigerant 180 is discharged from the output 162 of the compressor 160 into the condenser 170. The forced air flow across the condenser coil 170 transfer heat from the refrigerant 180 to ambient air. The cooled refrigerant 180 passes through the pressure differential valve 200 to enter the first end 151 of the evaporator coil 150 to again absorb heat from the thermally conductive liquid 145 within the interior 127 of the lower container 120.

The present invention provides an improved converter 70 for coupling a water cooled refrigeration system 10 with the recycling water cooler 40 for the conservation of water. The converter 70 enables the water cooled refrigeration system 10 to be operated in conjunction with the recycling water cooler 40 or may be operated independently thereof as originally designed as a water cooled refrigeration system 10. The converter 70 automatically transfers the water cooled refrigeration system 10 from operating in conjunction with the recycling water cooler 40 to operate as a conventional water cooled refrigeration system 10 upon the unlikely event of failure of the recycling water cooler 40. The converter 70 is low cost and easy to install in a wide variety of water cooled refrigeration systems and provides a considerable savings to the user of a water cooled refrigeration system.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An improved recycling water cooler for a water cooled refrigeration system located within a building structure, the water cooled refrigeration system having a first input and a first output, the water cooled refrigeration system transferring heat from a refrigerated volume to ambient water entering the first input from an ambient water source for discharging heated water from the first output into a drain, the improved recycling water cooler having a second input and a second output, the recycling water cooler being located outside of the building structure for transferring heat from the warm water entering the second input to ambient air and to discharge cool water from the second output, the improved comprising in combination:

first conduit means interconnecting the first input of the water cooled refrigeration system, the second output of the recycling water cooler and the ambient water source for enabling the flow of water therebetween;

second conduit means interconnecting the first output of the water cooled refrigeration system, the second input of the recycling water cooler and the drain for enabling the flow of water there between;

first valve means having a first and a second position interposed in said first conduit means;

second valve means having a first and a second position interposed in said second conduit means;

said first valve means and said second valve means having a first position for interconnecting the first output to the second input and for interconnecting the second output to the first input for enabling heated water discharged from first output of the water cooled refrigeration system to enter the second input of the recycling water cooler to be cooled by ambient air and to be returned from the second output into the first input of the water cooled refrigeration system for saving ambient water thereby; and said first and second valve means having a second position for interconnecting the first input to the ambient water source for discharging heated water from the first output into a drain for operating the water cooled refrigeration system in a conventional manner in the event of malfunction of the recycling water cooler.

2. An improved recycling water cooler for a water cooled refrigeration system as set forth in claim 1, wherein each of said first and second valve means is a three-way valve.

3. An improved recycling water cooler for a water cooled refrigeration system as set forth in claim 1, wherein said first and second valve means operate in unison.

4. An improved recycling water cooler for a water cooled refrigeration system as set forth in claim 1, including fluid couplings for interconnecting the converter to the water cooled refrigeration system and the recycling water cooler.

5. An improved recycling water cooler for a water cooled refrigeration system, the water cooled refrigeration system having a first input and a first output, the water cooled refrigeration system transferring heat from a refrigerated volume to ambient water entering the first input from an ambient water source for discharging heated water from the first output into a drain, the recycling water cooler having a second input and a second output, the recycling water cooler transferring heat from the warm water entering the second input for discharging cool water from the second output, the improved comprising in combination:

first conduit means interconnecting the first input of the water cooled refrigeration system, the second output of the recycling water cooler and the ambient water source for enabling the flow of water therebetween;

second conduit means interconnecting the first output of the water cooled refrigeration system, the second input of the recycling water cooler and the drain for enabling the flow of water therebetween;

first valve means having a first and a second position interposed in said first conduit means;

second valve means having a first and a second position interposed in said second conduit means;

control means connected to said first valve means and said second valve means for positioning said first and second valve means in said first position for interconnecting the first output to the second input and for interconnecting the second output to the first input for enabling heated water discharged from first; output of the water cooled refrigeration system to enter the second input of the recycling water cooler to be cooled thereby and to be returned from the second output into the first input of the water cooled refrigeration system;

said control means positioning said first and second valve means in said second position for interconnecting the first input to the ambient water source for discharging heated water from the first output into a drain for operating the water cooled refrigeration system in a conventional manner;

sensor means for generating a signal indicative of a malfunction of the recycling water cooler; and said control means positioning said first and second valve means in said second position for interconnecting the first input to the ambient water source for discharging heated water from the first output into a drain upon a signal indicative of a malfunction.

6. An improved recycling water cooler for a water cooled refrigeration system as set forth in claim 5, including alarm means for generating an alarm signal upon a signal indicative of a malfunction.

7. An improved recycling water cooler for a water cooled refrigeration system as set forth in claim 6, including a temperature sensor for generating a signal indicative of an excessive temperature proximate the second output of the recycling water cooler; and said control means positioning said first and second valve means in said second position for interconnecting the first input to the ambient water source for discharging heated water from the first output into a drain upon a signal indicative of an excessive temperature.

8. An improved recycling water cooler for a water cooled refrigeration system as set forth in claim 6, wherein the recycling water cooler includes a compressor;

a pressure sensor for generating a signal indicative of an excessive pressure in the compressor of the recycling water cooler; and said control means positioning said first and second valve means in said second position for interconnecting the first input to the ambient water source for discharging heated water from the first output into a drain upon a signal indicative of an excessive pressure.

9. An improved recycling water cooler for a water cooled refrigeration system as set forth in claim 6, wherein each of said first and second valves is a three-way valve.

10. An improved recycling water cooler for a water cooled refrigeration system as set forth in claim 6, wherein said control means operates said first and second valves in unison.

* * * * *